US005320565A

United States Patent [19]

Polidori

[11] Patent Number: 5,320,565

[45] Date of Patent: Jun. 14, 1994

[54] ELECTRICAL GRID INTERCONNECTOR

[75] Inventor: Mario D. Polidori, Medford Lakes, N.J.

[73] Assignee: Nicholas B. Polidori, Medford, N.J.

[21] Appl. No.: 35,912

[22] Filed: Mar. 23, 1993

Related U.S. Application Data

[63] Continuation of Ser. No. 537,595, Jun. 14, 1990, abandoned.

[51] Int. Cl.[5] ..... H01R 11/03

[52] U.S. Cl. ..... 439/791; 439/807

[58] Field of Search ..... 439/783, 784, 790, 791, 439/803, 805, 807, 811, 812

[56] References Cited

U.S. PATENT DOCUMENTS

| | | | |
|---|---|---|---|
| 4,114,977 | 9/1978 | Polidori | 439/791 |
| 4,415,222 | 11/1983 | Polidori | 439/807 |
| 4,911,572 | 3/1990 | Williams | 439/791 |
| 5,152,701 | 10/1992 | Polidori | 439/791 |

*Primary Examiner*—Gary F. Paumen
*Attorney, Agent, or Firm*—Norman E. Lehrer

[57] ABSTRACT

Improvements and modifications to an electrical grid interconnector initially adapted for electrically and mechanically interconnecting conductors in parallel which improvements and modifications permit the electrical connector to additionally connect the two conductors in perpendicular relationship. The connector includes a C-shaped clamp body member which has a lower surface, a flat back surface and a downwardly curved upper surface. A wedge member, moved by screw means relative to the body member, works against the lower surface of the C-shaped clamp member. A slot is provided in the clamp body member extending from the lower surface thereof upwardly through the rear wall and curved top wall thereof. Alternate conductor interface inserts are provided which are positioned between the two conductors to be interconnected. The first insert includes parallel conductor engaging upper and lower surfaces and the second insert includes perpendicular upper and lower conductor engaging surfaces thus permitting the conductors to be interconnected in parallel when the conductors run parallel to the clamp body member by use of the first interface insert and to be interconnected perpendicular to one another with one of the conductors extending through the conductor slot when the second interface insert is utilized.

3 Claims, 2 Drawing Sheets

ELECTRICAL GRID INTERCONNECTOR

This is a continuation of U.S. Ser. No. 07/537,595 filed Jun. 14, 1990, now abandoned.

BACKGROUND OF INVENTION

The present invention is directed toward an electrical connector and, more particularly, toward an electrical grid interconnector which is adapted to electrically and mechanically interconnect two electrical conductors such as an electrical transmission conductor to a distribution conductor.

The present applicant is the inventor in U.S. Pat. No. 4,415,222 issued Nov. 15, 1983. The subject matter of this patent is illustrated in FIG. 1 of the drawings as prior art. The disclosure in the applicant's U.S. Pat. No. 4,415,222 is hereby incorporated by reference into this patent application.

In summary, the applicant's prior patent discloses an electrical connector which utilizes a C-shaped clamp body member 10 which includes a bottom wall 11, a flat rear wall 12 and a downwardly curved top wall 13. The electrical connector of the applicant's prior patent further includes a wedge 14. The wedge 14 is moved axially of the body member 10 by means of a screw 15 passing through and journaled within a tab 16. One end of the screw 15 is threaded into a threaded bore 17 at its first end and works against the wedge at its opposite end as the screw 15 is turned by means of a nut 18 engaging the outside edge of the tab 16. Thus, as the screw member 15 is rotated by means of the nut 18 and is threaded within the threaded bore 17 of the body member 10, the wedge will advance. As the wedge 14 advances, the under surface 20 of the wedge 14 engages the upper surface 21 of the body member thus advancing the upper surface 21 of the wedge upwardly toward the curved top wall 13.

The electrical connector of the applicant's patent is designed to interconnect mechanically and electrically an upper conductor 22 and lower conductor 23 disposed in parallel relationship. The upper surface of conductor 22 is designed to engage the downwardly curved top wall 13 of the clamp body member whereas the lower surface of the lower conductor 23 engages a complementary elongate recess 24 (shown in FIG. 2) of the wedge 14.

Disposed between the upper conductor 22 and lower conductor 23 is a parallel conductor interface insert 25..The conductor interface insert 25 includes a conductor engaging upper surface 28 having formed therein a conductor engaging recess 29 which engages the upper conductor 22. In a like manner, the conductor interface insert 25 includes a conductor engaging lower surface 30 having formed therein a conductor engaging recess 31.

As the screw 15 is advanced relative to the clamp body member 10, the wedge will bring the upper surface 21 of the wedge into contact with the conductor 23 which, in turn, comes into engagement with the conductor engaging recess 31 of the conductor interface insert 25. In a like manner, the conductor engaging recess 29 of the conductor engaging insert 25 comes into engagement with the lower surface of the conductor 22 ultimately forcing the upper surface thereof into engagement with curved top wall 13.

The conductor interface insert 25 includes a tang 32 extending outwardly therefrom. The tang 32 is used in conjunction with a hot stick which grips the tang and is used to insert the tang between the conductors while the conductors are electrically charged. In a like manner, the nut 18 can drive the screw 15 by means of an insulated wrench mechanism to permit installation of the electrical connector with the conductors alive.

The electrical connector of the applicant's invention works exceedingly well with parallel conductors. However, to interconnect conductors at a transverse or perpendicular angle, an entirely different connector must be utilized. This is obviously a drawback in that a utility company or other concern utilizing such conductors must maintain a complete supply of two totally separate connectors. Accordingly, what is needed in the industry is a universal connector that will connect both parallel and perpendicular conductors.

SUMMARY OF INVENTION

The invention in the present application modifies the applicant's prior patented parallel electrical connector in a manner and fashion to permit the electrical connector to be used alternately for parallel or perpendicular interconnection of conductors.

In accordance with the invention, the rear wall of the conductor and downwardly curved top wall have formed therein a conductor slot adapted to accept a perpendicular conductor. In this manner, one conductor may be run parallel along the length of the C-shaped clamp body member and the other conductor run perpendicular thereto through the slot.

The present invention further includes an alternate perpendicular conductor interface insert which has one conductor engaging upper surface and its conductor engaging recess formed transverse or perpendicular to the other conductor engaging surface and its associated conductor engaging recess. Additionally, the wedge has formed on its upper surface transverse to the upper surface of the wedge a conductor engaging recess to facilitate insertion of the insert.

The perpendicular conductor interface insert is positioned between the upper and lower conductors in the same fashion as the parallel conductor interface insert by means of a gripping tang associated therewith. When the wedge is advanced relative to the C-shaped clamp body member, the perpendicular upper and lower conductors will be brought into electrical contact with their respective upper and lower conductor engaging grooves of the insert, the transverse conductor engaging the wedge upper surface while the upper conductor engages the downwardly curved top wall to thus provide firm electrical and mechanical contact of the conductors.

Whenever the electrical grid interconnector, as modified, is desired to be used for parallel connection, it may be used in the same manner as the electrical connector of the applicant's prior patent.

DETAILED DESCRIPTION OF INVENTION

Figure 1:
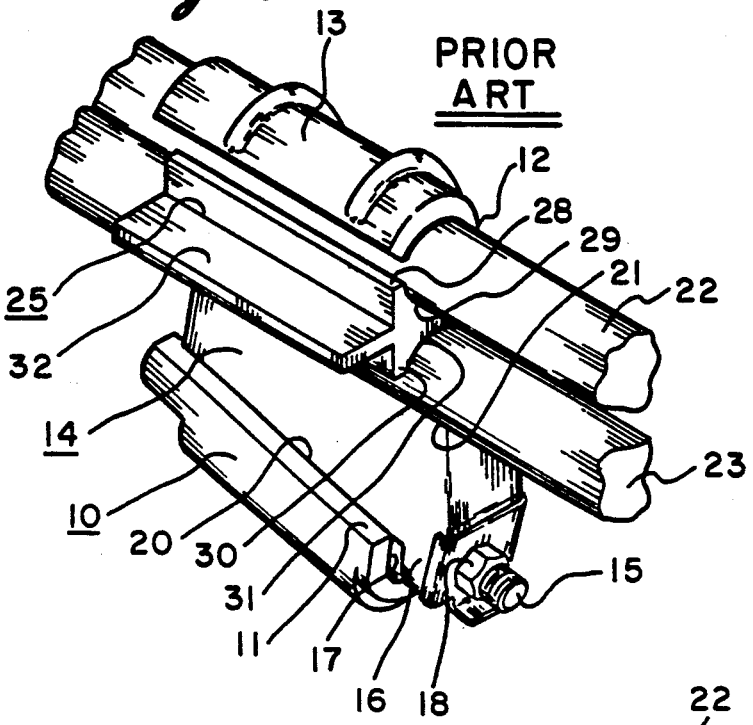
FIG. 1 is a perspective view of the electrical connector of applicant's prior U.S. Pat. No. 4,415,222.
Figure 2:
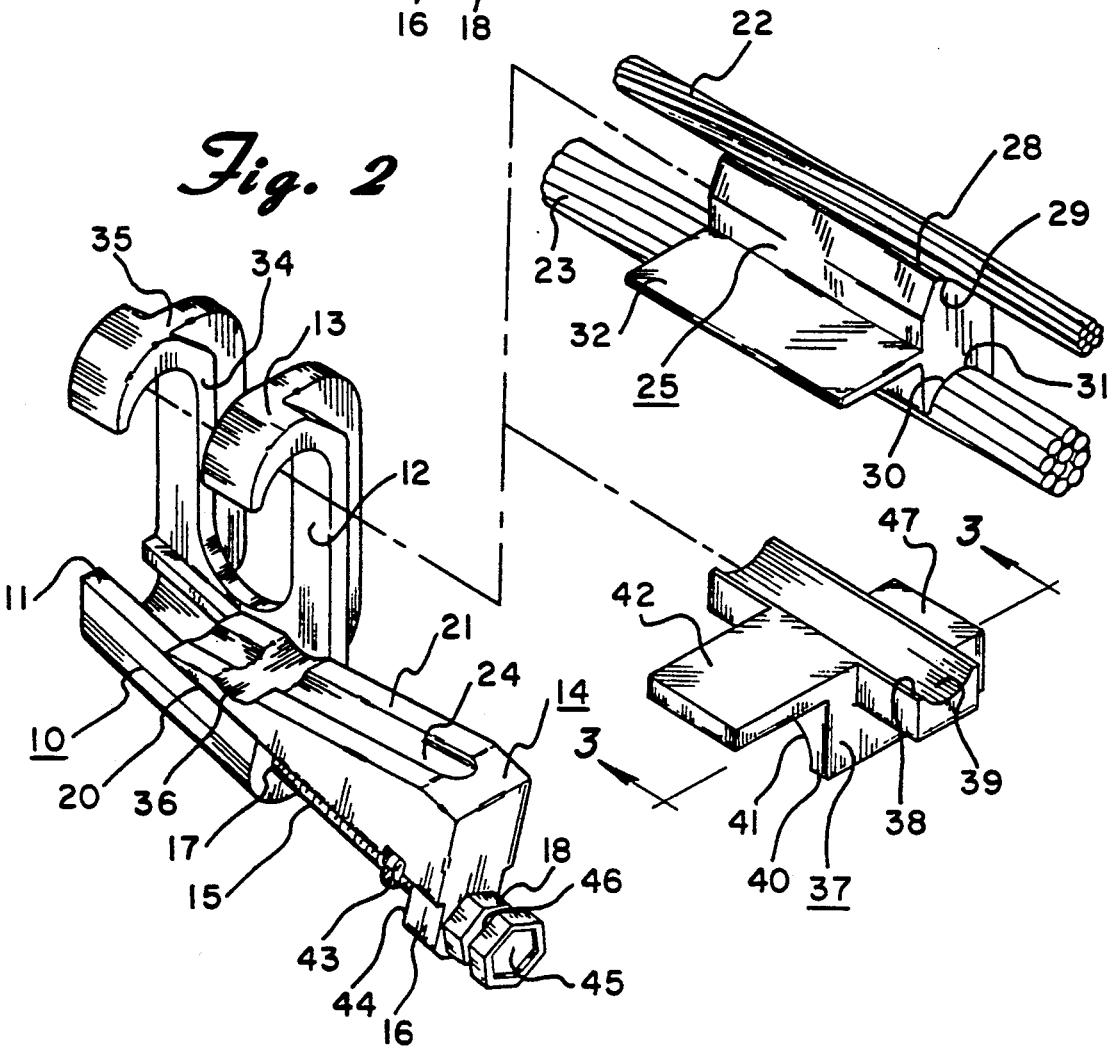
FIG. 2 is an exploded view of the electrical connector of the applicant's prior patent showing the modifications and/or additions made by the present invention.

The electrical connector of the applicant's prior U.S. Pat. No. 4,415,222 illustrated in FIG. 1 is illustrated in exploded view in FIG. 2. Like components set forth in FIGS. 1 and 2 are numbered identically and, to that extent, represent the structure of the applicant's prior patent constituting prior art. Accordingly, inasmuch as the components of applicant's prior electrical connector are covered by his patent have been discussed in the background of invention by reference to FIG. 1, it is not believed necessary to again discuss the common structural aspects of the applicant's prior art electrical connector to that of the present invention in reference to the description of FIGS. 2 and 4 and the same will only be done where necessary to reference the modifications made to the applicant's prior art device constituting the basis of his present invention.

In accordance with the applicant's present invention, the C-shaped clamp body member 10 is modified to include a perpendicular conductor slot 34. The conductor slot 34 extends from a position approximately at the level of the bottom wall 11 upwardly through the rear wall 12 and on through the extremity of the downwardly curved top wall 13. The slot is of a width as necessary to accommodate positioning within the slot of the largest conductor anticipated for which the electrical connector will be used. Reinforcing ribs 35 are positioned on the rear wall portions remaining to add strength to the rear wall 12 and the top wall 13.

The wedge 14 is modified to include a transverse or perpendicular conductor engaging recess 36 in the upper surface 21 of the wedge 14. The positioning of the conductor engaging recess 36 along the elongate upper surface 21 of the wedge 14 is positioned on the forward edge of the upper surface 21 and provides extra relief to the cable which will be passing transverse through the C-shaped clamp member 10 to aid in the insertion of a perpendicular conductor interface insert to be discussed hereinafter.

Figure 3:
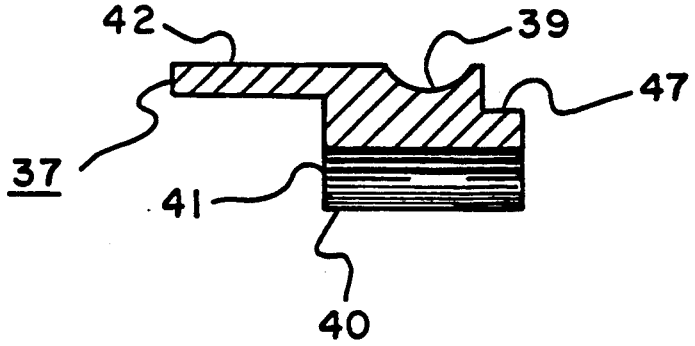
FIG. 3 is a view along the lines 3—3 of FIG. 2 showing in section the modified connector interface insert.

In accordance with the present invention and as shown in FIGS. 2 and 3, the applicant's patented prior art electrical conductor is further modified to provide for perpendicular intersection of conductors by the utilization of a perpendicular conductor interface insert 37. The perpendicular conductor interface insert 37 includes a conductor engaging upper surface 38. Formed within the upper surface 38 is a conductor engaging recess or 39. In a like manner and perpendicular to the upper surface 38, the conductor interface insert 37 includes a conductor engaging lower surface 40 which has formed therein a conductor engaging recess 41. The perpendicular conductor interface insert 37 further includes a gripping tang 42. Additionally, the interface insert 37 includes a slot engaging extension 47 of width slightly less than that of the conductor slot 34.

The drive screw 15 in the electrical grid interconnector of the present invention has been further modified over the applicant's patented prior art device in the utilization of a snap ring 43 snapped upon and secured to the drive screw 15 adjacent the inner surface 44 of the wedge tab 16. The snap ring thus prevents the wedge from moving forward on the screw which is threaded into the threaded bore 17 of the clamp body member 10.

The drive screw 15 has been further modified in accordance with the present invention to provide nut 18 formed into the drive screw 15 on the opposite side of the wedge tab 16 from the snap ring 43. In this manner, the wedge 14 is locked against movement axially in either direction upon the drive screw 15.

The drive screw 15 has also been additionally modified in accordance with the present invention to add a torque nut 45. The torque nut 45 is aligned at an angle such that the flats on the torque nut 45 and the nut 18 are in 30° misalignment. This misalignment, taken in conjunction with the nut sizes, adds support to the socket driving the torque nut 45. The torque nut 45 is machined or otherwise formed integrally with the drive screw 15 by means of a shank 46. The shank 46 is of a diameter less than that of the drive screw 15 and is designed to have a torsional shear strength of that of the desired torque to be applied to the drive screw 15.

In a typical embodiment, the nut 18 is of a 9/16" bolt head size while the torque nut 45 is of a ⅝" bolt head size and the shank is of approximately 3/16" in diameter and will shear at 100 inch pounds of torque. The grid interconnector may be made of bronze material for copper to copper cable connection and of aluminum material for aluminum to aluminum connection.

Figure 4:
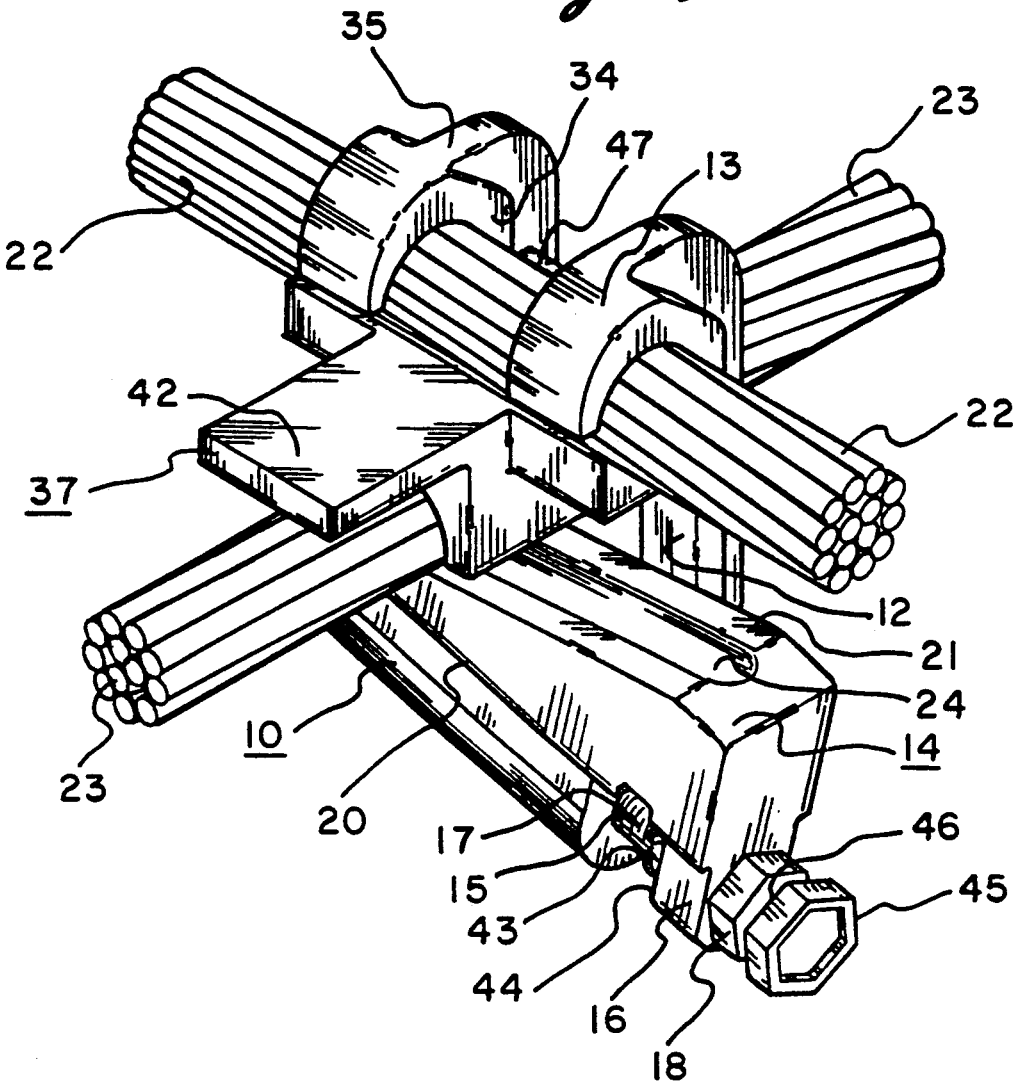
FIG. 4 is an assembled view of the electrical grid interconnector of the present invention incorporating the modifications and/or additions thereto set forth in this application.

During assembly and as shown in FIGS. 2 and 4, the drive screw 15 is driven inwardly to bring the conductor engaging recess 36 into alignment with the conductor slot 34. The clamp body member 10 is then positioned with the lower conductor passing through the conductor slots 34. The clamp body member is then positioned upon the conductor which runs parallel with the clamp body member with the downwardly curved top wall 36 engaging the conductor. Thereafter, the perpendicular conductor interface insert 37 is inserted in place between the two conductors generally as illustrated in FIG. 2.

Following positioning of the clamp body 10 and conductor interface insert 37, the drive screw 15 is driven by the torque nut 45 to drive the wedge into engagement with the lower conductor which, in turn, engages the conductor interface 37 forging it into contact with the upper conductor which finally engages the curved top wall 13. The torque nut 45 will continue to be driven until the appropriate torque is reached at which point the torque nut 45 will shear off at the shank 46 thus preventing over torquing.

Removal of the electrical connector is accomplished by reverse threading the drive screw 15 by use of a wrench or other suitable member upon the nut 18. The snap ring 43 will engage the inner surface 44 of the wedge tab 16 and pull the wedge out of wedging engagement with the conductors and perpendicular conductor interface insert 37.

Whenever it is desired to connect parallel conductors, then the same C-shaped clamp body member 10 and its associated wedge and drive screw components are utilized but, instead, the parallel conductor interface insert 25 is utilized as in the prior art device previously described.

From the foregoing description of a preferred embodiment of the modifications and additions to the electrical connector of my patented prior electrical connector, it will be appreciated that the electrical grid interconnector of the present invention may be utilized both for parallel connection and for transverse or perpendicular connection with the only additional component being required to be maintained by a user is the perpendicular conductor interface insert. Accordingly, a utility company or other entity utilizing the electrical connector need only store one additional component and the majority of the other components remain the same irrespective of whether or not a parallel or a perpendicular connection is desired.

The present invention may be embodied in other specific forms without departing from the spirit or essential attributes thereof and accordingly, reference should be made to the appended claims rather than to the foregoing specification as indicating the scope of the invention.

I claim:

1. In an electrical connector assembly adapted to electrically and mechanically connect two electrical conductors one to another which electrical connector includes a substantially C-shaped body member having a substantially flat rear wall terminating in a downwardly curved top wall at the upper portion thereof and terminating in a bottom wall at the lower portion thereof; an elongated wedge movable within the C-shaped body member in a direction parallel to said rear wall, said wedge being in engagement with the lower wall; screw means for moving the wedge along the bottom wall and wherein the slope of the wedge is such that the upper surface of the wedge is moved toward the top wall as the wedge is moved toward the interior of the body member; and a removable conductor interface insert having a conductor engaging upper surface and a conductor engaging lower surface each adapted to engage one of the conductors as the wedge is moved inwardly of the interior of the C-shaped body member further bringing one of the conductors into engagement with the curved top wall and the remaining conductor into engagement with the wedge for facilitating interconnection between said conductors; the improvements permitting interconnection of electrical conductors perpendicular to one another comprising:

a perpendicular conductor slot cut into the C-shaped clamp body member beginning at a point in the vicinity of the bottom wall extending upwardly through the rear wall and through the entirety of the downwardly curved top wall;

a perpendicular conductor interface insert having a conductor engaging lower surface and a conductor engaging upper surface wherein the lower surface and upper surface are perpendicular to one another whereby one of the conductors may be positioned through the C-shaped clamp body member parallel thereto and the other conductor positioned perpendicular to the C-shaped clamp body member within the perpendicular conductor slot with the perpendicular conductor interface insert positioned between the conductors to permit the electrical connector to be used for perpendicular interconnection of said two conductors;

said wedge including a conductor engaging groove therein perpendicular to the upper surface of the wedge for engaging said perpendicular positioned conductor for facilitating said perpendicular interconnection, and a grasping tang attached to and extending from said perpendicular conductor interface insert, said tang being located closer to said upper conductor engaging surface than to said lower conductor engaging surface and extending substantially outwardly from said insert in a direction perpendicular to said C-shaped body member, said tang being vertically spaced from said lower conductor engaging surface and from said perpendicular positioned conductor so that said tang can be grasped for insertion and removal of said interface insert without interference by said perpendicular positioned conductor.

2. The electrical connector of claim 1 wherein the screw means is threaded into a threaded bore within the clamp body member and secured within the wedge member for rotational movement but secured against axial movement relative thereto to permit forward and reverse driving of the wedge relative to the C-shaped clamp body member.

3. The electrical connector of claim 2 wherein the screw means is of a first diameter at its first end where the screw means engages the threaded bore and terminates at its opposite end in a torque receiving means interconnected to the screw means through a shank of lesser diameter to provide shear of the torque receiving means from the remaining screw means to set the torque requirement of the screw means.

* * * * *